United States Patent [19]

Vernino

[11] Patent Number: 4,495,641

[45] Date of Patent: Jan. 22, 1985

[54] MICROPHONE PICKUP FOR MUSICAL INSTRUMENTS

[76] Inventor: Raymond Vernino, 155 Yo. Hubbard Rd., #9, Hubbard, Ohio 44425

[21] Appl. No.: 512,345

[22] Filed: Jul. 11, 1983

[51] Int. Cl.[3] ..... H04R 1/46

[52] U.S. Cl. ..... 381/91; 84/1.14; 179/111 R; 179/121 R

[58] Field of Search ..... 381/113, 118, 67, 91; 179/111 R, 111 E, 121 C, 121 R; 84/1.16, 1.14, 1.04; 248/206 R

[56] References Cited

U.S. PATENT DOCUMENTS

| | | | |
|---|---|---|---|
| 2,314,803 | 3/1943 | Wagner et al. | 248/206 R |
| 2,432,719 | 12/1947 | Braun | 248/206 R |
| 2,557,434 | 6/1951 | Hoverder | 248/206 R |
| 2,769,867 | 11/1956 | Crounover | 84/1.16 |
| 3,538,232 | 11/1970 | Bachtig et al. | 84/1.14 |
| 3,582,554 | 6/1971 | Le Blang | 179/84 VF |
| 4,047,109 | 9/1977 | Sekiguchi | 381/78 |
| 4,191,854 | 3/1980 | Coles | 179/84 L |
| 4,421,288 | 12/1983 | Blaszkowski | 248/206 R |
| 4,446,335 | 5/1984 | Lee et al. | 179/2 C |

OTHER PUBLICATIONS

Radio Shack Catalog 1980, "Telephone Pickup Coil", p. 51.

*Primary Examiner*—Gene Z. Rubinson
*Assistant Examiner*—Danita R. Byrd
*Attorney, Agent, or Firm*—Thomas H. Murray

[57] ABSTRACT

An audio pickup for musical instruments employing a condenser-type microphone mounted on a suction cup which is pressed against the sounding board or the like of the instrument.

5 Claims, 5 Drawing Figures

MICROPHONE PICKUP FOR MUSICAL INSTRUMENTS

BACKGROUND OF THE INVENTION

The present invention relates generally to a musical pickup arrangement for the conversion of sound vibrations into electrical oscillations, and more specifically, to a musical pickup arrangement incorporating a condenser-type microphone for converting sound vibrations generated in a musical instrument into electrical signals that can be supplied to a loud-speaker.

As is known, microphones and other transducers have been employed in connection with musical instruments to convert sound vibrations into electrical oscillations. By means of suitable electronic apparatus, these electrical oscillations have been amplified and reconverted into audible sounds. In certain cases, piezoelectric translating devices have been employed in pianos and stringed instruments for converting mechanical vibrations of the resonator or sounding board of the instrument into electrical oscillations which, in turn, have been amplified and reconverted into audible sounds. These devices have been placed, for example, directly on the sounding board of the musical instrument and at various other locations above the sounding board, as evidenced by the prior art. However, the sound produced by each of these arrangements has generally been poor. The reasons why the sound produced by such transducers is often poor is perhaps due to the fact that the device is secured directly to the sounding board. This may, for example, be due to the fact that the natural frequency of the sounding board is altered when contacted by the pickup.

In other cases, contact pickup devices used on musical instruments have been of the magnetic-induction type. In these devices, a vibrating or resonating cavity is in contact with a coiled magnet which transduces the vibrations of the cavity into small electrical impulses, thus creating the transformation of magnetic to electrical energy.

The magnetic-induction type of transducer has been quite reliable for many years; however a falsification of the actual color or "timbre" of certain instruments is lost when this type of pickup is used on a nylon-stringed guitar or the like. Of the six strings on the classical guitar, the top three are made of pure nylon, similar to a nylon fishing line, but milled to various thicknesses. The bottom three base strings have a nickel alloy wrapping around several fine threadlike nylon strands. A magnetic pickup device used on this type of instrument transforms sound from the bottom three base strings evenly due to their outer conductive coating, but the non-conductive nature of the top three treble strings prevents an even transfer of energy and usually results in sound which is uncharacteristic, or "tinny".

SUMMARY OF THE INVENTION

In accordance with the present invention, there is provided a new and improved audio pickup adapted to be secured to a musical instrument or the like, which obviates the disadvantages of prior art pickups and which employs a condenser-type microphone secured to the sounding board of a musical instrument by means of a suction cup such that the condenser-type microphone is spaced from the sounding board and is subjected to the vibrations of the instrument by its sound-pressure characteristics and through an extended form of contact.

Specifically, there is provided a suction cup in the general form of a spherical segment formed from elastic material and having a projection extending upwardly from the top thereof. An open-ended, cup-shaped recess is formed in the projection, the recess having a closed bottom above the inner periphery of the suction-cup segment. A condenser-type microphone is received within the recess but is spaced from the bottom of the recess to form an airtight resonating chamber which adsorbs vibrations picked up through contact. With this arrangement, and when the suction cup is pressed against the sounding board of a musical instrument with the microphone out of physical contact therewith, sound vibrations in the sounding board are transmitted to the condenser-type microphone which meshes together both the vibrating and resonated forms of the sound vibrations.

The above and other objects and features of the invention will become apparent from the following detailed description taken in connection with the accompanying drawings which form a part of this specification, and in which.

Figure 1:
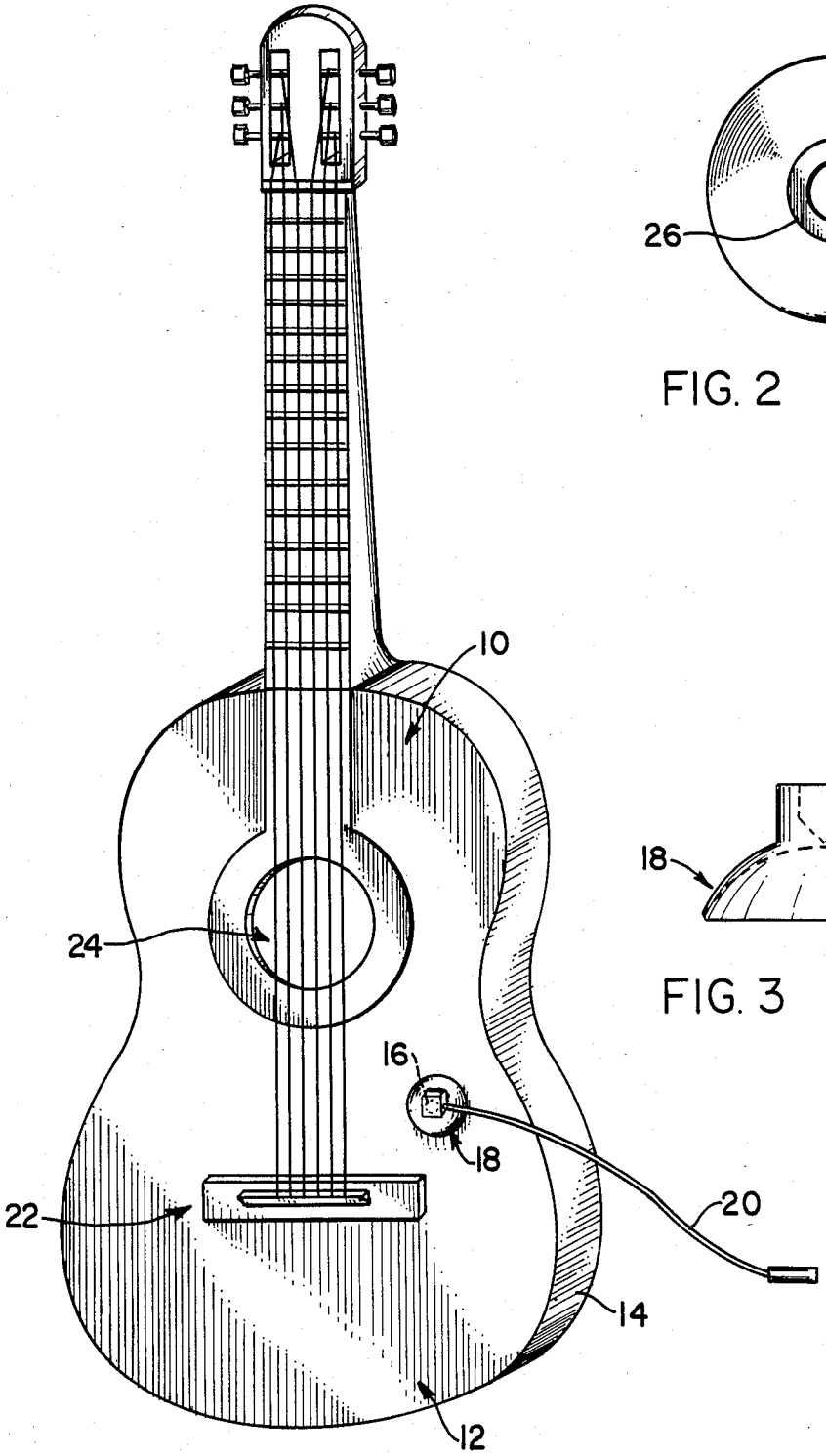
FIG. 1 is a perspective view of the invention as applied to a conventional guitar.

With reference now to the drawings, and particularly to FIG. 1, there is shown a musical instrument 10, in this case a guitar having a sounding board 12 on the top side of a resonator 14. In accordance with the present invention, a small condenser-type microphone 16 is mounted on a suction cup 18 which is pressed against the sounding board 12. Above the microphone 16, as will hereinafter be described in detail, is a housing containing a source of direct current potential, such as a battery, and an OFF-ON potentiometer, these elements serving to establish a potential across the plates of the condenser microphone. The output of the device on lead 20 is an audio signal which can be applied to an amplifier and loud-speaker.

Placing the suction cup 18 and microphone 16 below the bridge 22 at the lower end of the sounding board 12 tends to emphasize the base notes (i.e., makes the lower three strings sound more pronounced). An extreme in the other direction near the top of the sounding board above the sound hole 24 has a tendency to accent the three upper or treble strings. Preferably, the microphone and suction cup are positioned between the sound hole 24 and bridge 22 to deliver an even balance between the base and treble strings of the guitar.

Figure 2:
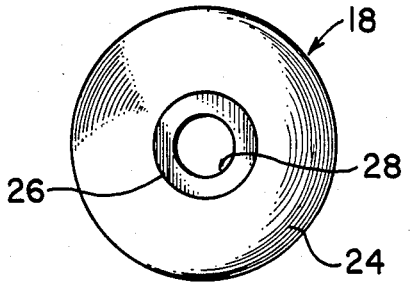
FIG. 2 is a top view of the suction cup used in the invention.
Figure 3:
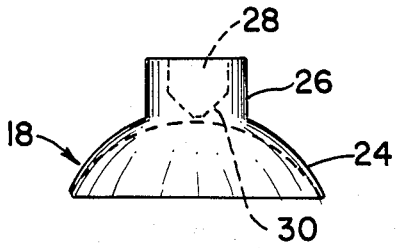
FIG. 3 is a side view of the suction cup shown in FIG. 2.

The details of the suction cup 18 are shown in FIGS. 2 and 3. It is formed from rubber or some other elastomeric material and has a lower portion 24 in the general form of a segment of a sphere. Extending upwardly from the segment 24, and integral therewith, is a rubber or the like projection 26 having an open-ended, cup-shaped recess 28 formed therein. It will be noted that the recess 28 does not extend entirely through the projection 26 so that a layer 30 of rubber or the like material is formed between the bottom of the recess 28 and the interior of the suction cup 18. For best results, it has been found that the suction cup should be formed from a soft polyvinyl material.

Figure 4:
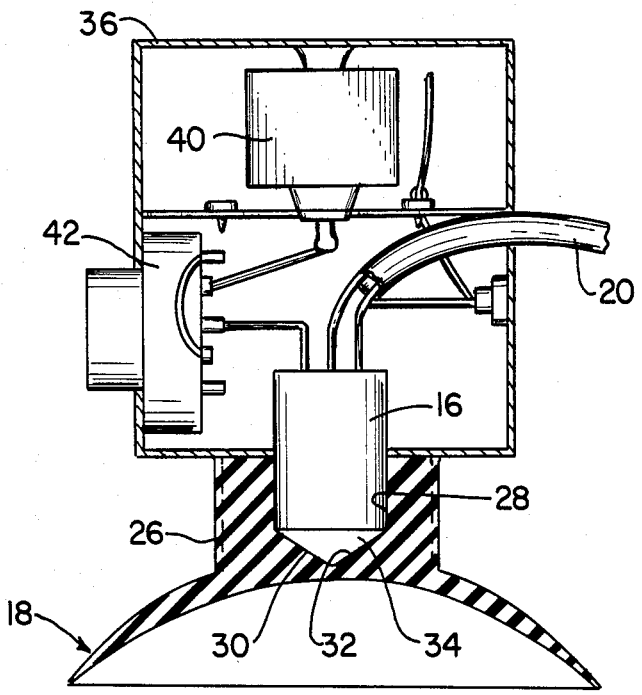
FIG. 4 is a detailed illustration of the invention in combination with its power supply.

As shown in FIG. 4, the recess 28 receives the condenser-type microphone 16. Insertion of the condenser microphone 16 into the cup-shaped recess 28 must be done precisely. For example, a hollow cavity 47/64 inch wide by ⅜ inch deep is bored into the projection 26. The condenser microphone 16 is then worked by hand into the recess 28 until exactly one-half (i.e., ¼ inch) of the microphone 16 is lodged inside the recess 28. Note that the recess 28 has a cone-shaped bottom 32. This forms a small diaphragm-like cavity 34 typically measuring 47/64 inch wide by ⅛ inch deep between the bottom of the condenser microphone 16 and area 30 of the suction cup 18.

The function of the diaphragm-like cavity 34 is to create an airtight resonator chamber that absorbs vibrations picked up through contact. In this respect, the sound absorbed through contact is reflected inside the small diaphragm-like cavity 34, which causes the diaphragm of the condenser-type microphone 16 to move, thus inducing a current which flows out from the condenser element. In a condenser-type microphone, a diaphragm, in conjunction with a fixed counterelectrode, forms a condenser whose capacitance varies with the vibrations of the diaphragm. Applied across the condenser is a direct current voltage which, in response to vibrations of the diaphragm, has an alternating voltage superimposed upon it. With each sound disturbance that is induced onto the diaphragm of the microphone, the electrostatic flux lines which exist betwen the plates of the microphone are set in motion. This causes a change in capacitance and, hence, a change in output voltage appearing as an audio signal.

In FIG. 4, there is mounted directly above the suction cup 18 and microphone 16 a housing 36 which contains a direct current battery 40 and an OFF-ON potentiometer 42. The housing and its enclosed elements, of course, could also be spaced from the suction cup and microphone if desired.

Figure 5:
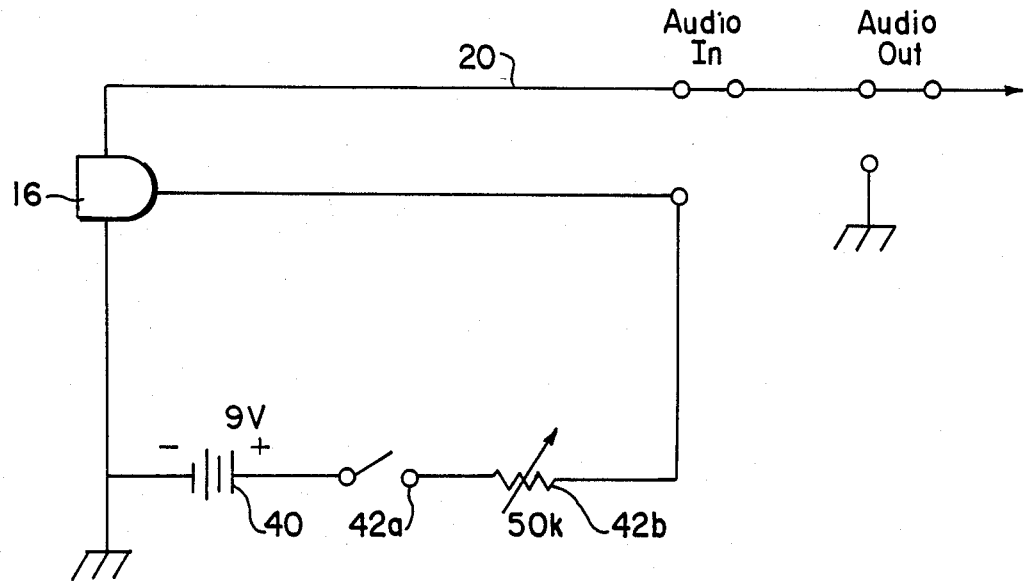
FIG. 5 is a schematic circuit diagram of the electrical circuitry utilized with the microphone of the invention.

In FIG. 5, the circuitry connected to the condenser microphone is shown. It includes the battery 40 connected in series with an ON-OFF switch 42A and a potentiometer 42B between the plates of the condenser-type microphone 16. The plates are also connected between ground and the output lead 20 such that an audio signal will appear between lead 20 and ground. Lead 20, in turn, may be connected to an amplifier and loud-speaker as described above. The ON-OFF switch is necessary in that the condenser microphone will draw approximately 167 microamps in a closed circuit with the 50K variable pot control at maximum resistance. With the pot control at minimum resistance, the condenser microphone will draw in excess of 450 microamps, depending upon the charge left in the battery. Either situation left unguarded will result in a relatively short life expectancy of the battery.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In combination, an audio pickup adapted to be secured to a musical instrument or the like comprising a suction cup in the general form of a hollow spherical segment formed from elastomeric material, a projection extending upwardly from the top of said spherical segment, an open-ended, cup-shaped recess formed in said projection, said recess having a closed bottom above the inner periphery of said segment, a condenser-type microphone received within said recess with the bottom of said microphone spaced from the bottom of said recess to form in said recess an airtight-resonating chamber, and a musical instrument having a resonator means including a sounding board, said suction cup being pushed against the sounding board to affix the audio pickup thereon with said microphone out of contact therewith such that sound vibrations from the sounding board are transmitted to said condenser-type microphone through said resonating chamber.

2. The combination of claim 1 wherein the bottom of said resonating chamber is cone-shaped in configuration.

3. The combination of claim 1 wherein a portion of said spherical segment forms a wall between said resonating chamber and the inner periphery of said spherical segment, and sound vibrations are transmitted to said condenser-type microphone by sound pressure disturbances created within said resonating chamber by muted contact vibrations passing through said wall.

4. The combination of claim 1 including a source of direct current voltage connected between the plates of said condenser-type microphone, and output lead means connected between the plates of said condenser-type microphone.

5. The combination of claim 4 wherein said direct current voltage source is in series with a potentiometer, the voltage source and potentiometer being mounted in a housing mounted on said projection.

* * * * *